US009001142B2

(12) United States Patent
Park et al.

(10) Patent No.: US 9,001,142 B2
(45) Date of Patent: Apr. 7, 2015

(54) DEVICE AND METHOD FOR MAPPING COLOR GAMUT

(71) Applicant: Samsung Display Co., Ltd., Yongin, Gyeonggi-do (KR)

(72) Inventors: Jong-Woong Park, Yongin (KR); Yong-Seok Choi, Yongin (KR); Won-Woo Jang, Yongin (KR); Byung-Ki Chun, Yongin (KR); Joo-Hyung Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 261 days.

(21) Appl. No.: 13/687,999

(22) Filed: Nov. 28, 2012

(65) Prior Publication Data

US 2014/0028700 A1 Jan. 30, 2014

(30) Foreign Application Priority Data

Jul. 25, 2012 (KR) ..... 10-2012-0081261

(51) Int. Cl.
*G09G 5/02* (2006.01)

(52) U.S. Cl.
CPC ..... *G09G 5/02* (2013.01); *G09G 2340/06* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 2007/0058183 | A1* | 3/2007 | Osaki et al. | 358/1.9 |
| 2008/0089604 | A1 | 4/2008 | Kim et al. | |
| 2008/0266314 | A1* | 10/2008 | Butterworth | 345/590 |
| 2010/0097406 | A1* | 4/2010 | Zulch | 345/690 |
| 2012/0212515 | A1* | 8/2012 | Hamer et al. | 345/690 |
| 2013/0222414 | A1* | 8/2013 | Ito et al. | 345/600 |

FOREIGN PATENT DOCUMENTS

| | | |
|---|---|---|
| KR | 10-2008-0034690 | 4/2008 |
| KR | 10-2010-0041091 | 4/2010 |
| KR | 10-2011-0047669 | 5/2011 |

* cited by examiner

*Primary Examiner* — Phi Hoang
*Assistant Examiner* — Mohammad H Akhavannik
(74) *Attorney, Agent, or Firm* — Knobbe Martens Olson & Bear LLP

(57) ABSTRACT

A device for mapping a color gamut includes a color gamut determinator and a color gamut mapper. The color gamut determinator determines an output color gamut using a gain value corresponding to information of a first color gamut, information of a second color gamut and a control condition. The color gamut mapper converts the color gamut of an input image data into the output color gamut. Accordingly, it is possible to provide a device and method for mapping a color gamut, which can determine an optimal color gamut corresponding to a change in control condition, and accordingly improve color accuracy and color reproducibility.

6 Claims, 3 Drawing Sheets

HSV color space

DEVICE AND METHOD FOR MAPPING COLOR GAMUT

CROSS-REFERENCE TO RELATED APPLICATIONS

This application claims priority to and the benefit of Korean Patent Application No. 10-2012-0081261, filed on Jul. 25, 2012, in the Korean Intellectual Property Office, the entire content of which is incorporated herein by reference.

BACKGROUND

1. Field

An aspect of the present invention relates to a device and method for mapping a color gamut, and more particularly, to a device and method for mapping a color gamut, which can improve color accuracy and color visibility.

2. Description of the Related Technology

As an image display device is developed in the direction of high resolution and high definition, the color reproducibility of the image display device is improved. Since a color reproduction region, i.e., a color gamut, which can be expressed in the image display device, is changed depending on characteristics of the image display device, it is required to perform color gamut mapping for compressing the color gamut or extending the color gamut so as to be suitable the characteristics of the image display device.

For example, in a case where a standard RGB (hereinafter, referred to as sRGB) image that is the standard of high-definition televisions (HDTVs) is displayed in a liquid crystal display device having a wide color gamut (hereinafter, referred to as WCG) greater than the color gamut of the sRGB image, it is required to perform a color gamut mapping method of extending the color gamut of the sRGB image to the WCG.

In the color gamut mapping method, the color gamut should be compressed or extended so that the chrominance recognized by a person is minimized.

However, the conventional color gamut mapping method does not reflect characteristics of an image, external illumination intensity, and the like. Therefore, color accuracy and color reproducibility are lowered.

SUMMARY OF CERTAIN INVENTIVE ASPECTS

Embodiments provide a device and method for mapping a color gamut, which can determine an optimal color gamut corresponding to a change in control condition, and accordingly improve color accuracy and color reproducibility.

According to an aspect of the present invention, there is provided a device for mapping a color gamut, including: a color gamut determinator that is configured to determine an output color gamut using a gain value corresponding to information of a first color gamut, information of a second color gamut and a control condition; and a color gamut mapper that is configured to convert the color gamut of an input image data into the output color gamut.

The information of the first color gamut may include lattice points of the first color gamut, and the information of the second color gamut may include lattice points of the second color gamut.

The color gamut determinator may compute lattice points of the output color gamut through an operation of the lattice points of the first color gamut, the lattice points of the second color gamut and the gain value.

The lattice point of the output color gamut may be computed by the following formula:

$$LPo=(LP1-LP2)*G+LP2$$

Here, LPo denotes lattice points of the output color gamut, LP1 denotes lattice points of the first color gamut, LP2 denotes lattice points of the second color gamut, and G denotes a gain value.

The gain value may be set to $0 \le G \le 1$ (G denotes a gain value).

The control condition may include at least one of chroma, intensity, and multiplication of the chroma and the intensity.

The device may further include an image analyzer that is configured to compute at least one of the chroma and intensity of the input image data and to transfer the computed one to the color gamut mapper.

The control condition may include an external illumination degree.

The device may further include an illumination intensity sensor that is configured to sense the external illumination degree and to transfer the sensed external illumination degree to the color gamut mapper.

The device may further include a data store that is configured to store the gain value corresponding to the control condition.

The correspondence relationship between the control condition and the gain value may be defined by a function.

The function of the control condition and the gain value may be defined by a parameter transferred from an external microcomputer (MICOM).

The parameter may include a start point, a first inflection point and an end point.

The parameter may include a start point, a first inflection point, a second inflection point, a third inflection point and an end point.

According to another aspect of the present invention, there is provided a method of mapping a color gamut, including: receiving an input image data; detecting a control condition including at least one of chroma of the input image data, intensity of the input image data, multiplication of the chroma and the intensity, and external illumination degree; determining an output color gamut using a gain value corresponding to information of a first color gamut, information of a second color gamut and the control condition; and converting the color gamut of the input image data into the output color gamut.

The information of the first color gamut may include lattice points of the first color gamut, and the information of the second color gamut includes lattice points of the second color gamut.

Lattice points of the output color gamut may be computed through an operation of the lattice points of the first color gamut, the lattice point of the second color gamut and the gain value.

The lattice point of the output color gamut may be computed by the following formula:

$$LPo=(LP1-LP2)*G+LP2$$

Here, LPo denotes lattice points of the output color gamut, LP1 denotes lattice points of the first color gamut, LP2 denotes lattice points of the second color gamut, and G denotes a gain value.

The gain value may be set to $0 \le G \le 1$ (G denotes a gain value).

The correspondence relationship between the control condition and the gain value may be defined by a function.

The function of the control condition and the gain value may be defined by a parameter transferred from an external MICOM.

The parameter may include a start point, a first inflection point and an end point.

The parameter may include a start point, a first inflection point, a second inflection point, a third inflection point and an end point.

As described above, according to embodiments of the present invention, it is possible to provide a device and method for mapping a color gamut, which can determine an optimal color gamut corresponding to a change in control condition, and accordingly improve color accuracy and color reproducibility.

BRIEF DESCRIPTION OF THE DRAWINGS

The accompanying drawings, together with the specification, illustrate certain embodiments of the present invention, and, together with the description, serve to explain the principles of the present invention.

DETAILED DESCRIPTION OF CERTAIN INVENTIVE EMBODIMENTS

Figure 1:
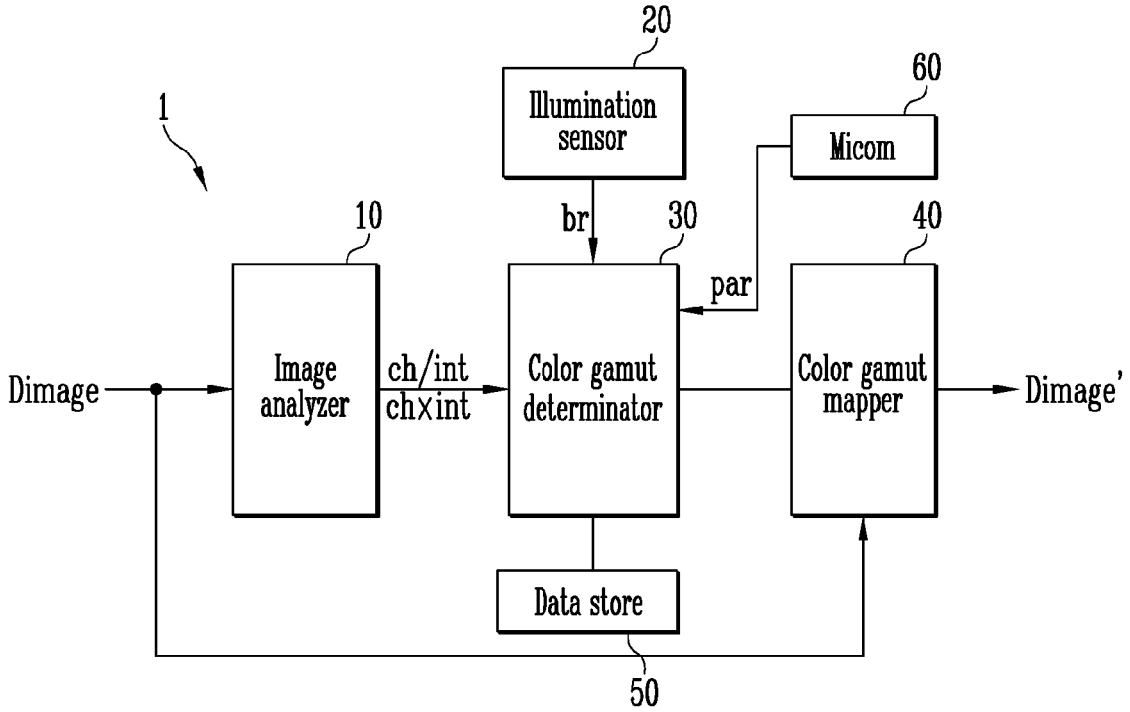
FIG. 1 is a block diagram showing a device for mapping a color gamut according to an embodiment of the present invention.

In the following detailed description, only certain embodiments of the present invention have been shown and described, simply by way of illustration. As those skilled in the art would realize, the described embodiments may be modified in various ways, without departing from the spirit or scope of the present invention. Accordingly, the drawings and description are to be regarded as illustrative in nature and not restrictive. In addition, when an element is referred to as being "on" another element, it can be directly on the other element or be indirectly on the other element with one or more intervening elements interposed therebetween. Also, when an element is referred to as being "connected to" another element, it can be directly connected to the other element or be indirectly connected to the other element with one or more intervening elements interposed therebetween. Hereinafter, like reference numerals generally refer to like elements.

Hereinafter, a device for mapping a color gamut and a method thereof according to the present invention will be described with reference to embodiments and the accompanying drawings.

FIG. 1 is a block diagram showing a device for mapping a color gamut according to an embodiment of the present invention.

Referring to FIG. 1, the device according to this embodiment includes a color gamut determinator 30 and a color gamut mapper 40.

The color gamut determinator 30 may determine an output color gamut using a gain value corresponding to information on a first color gamut, information of a second color gamut and a control condition.

Figure 2:
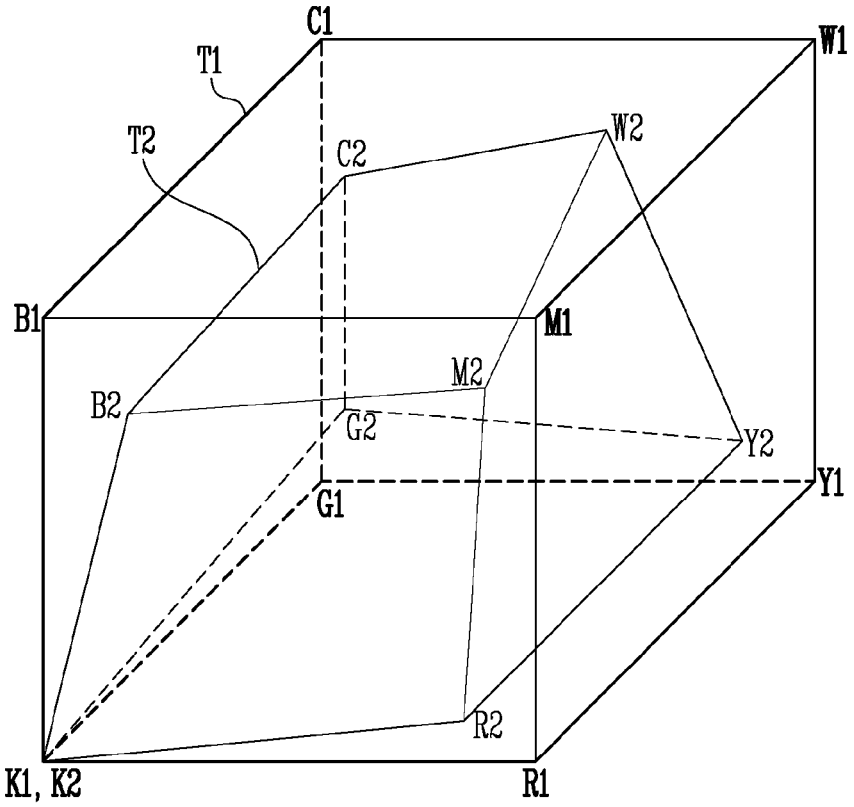
FIG. 2 is a diagram showing a first color gamut and a second color gamut according to an embodiment of the present invention.
Figure 3:
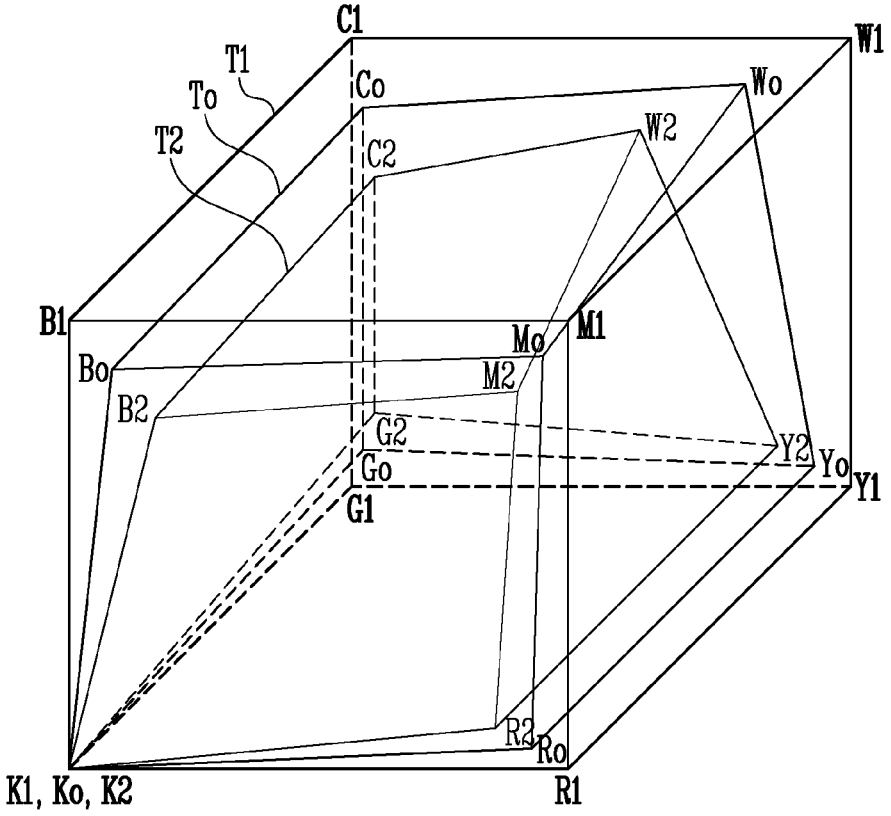
FIG. 3 is a diagram showing an output color gamut according to an embodiment of the present invention.

FIG. 2 is a diagram showing the first color gamut and the second color gamut according to an embodiment of the present invention. FIG. 3 is a diagram showing the output color gamut according to the embodiment of the present invention.

Referring to FIG. 2, the information of the first color gamut T1 may include lattice points LP1 of the first color gamut T1, and the information of the second color gamut T2 may include lattice points LP2 of the second color gamut T2.

For example, the range of the first color gamut T1 may be determined by the lattice points LP1 composed of a red point R1, a green point G1, a blue point B1, a cyan point C1, a magenta point M1, a yellow point Y1, a white point W1 and a black point B1.

The range of the second color gamut T2 may be determined by the lattice points LP2 composed of a red point R2, a green point G2, a blue point B2, a cyan point C2, a magenta point M2, a yellow point Y2, a white point W2 and a black point B2.

For example, a case where the range of the first color gamut T1 is wider than that of the second color gamut T2 is shown in FIG. 2.

In order to determine the range of the output color gamut To, the color gamut determinator 30 may compute lattice points LPo of the output color gamut To through an operation using the lattice points LP1 of the first color gamut T1 included in the information of the first color gamut T1, the lattice points LP2 of the second color gamut T2 included in the information of the second color gamut T2, and a gain value G.

Specifically, for example, the lattice points LPo of the output color gamut To may be computed through the following formula.

$$LPo=(LP1-LP2)*G+LP2$$

Here, LPo denotes lattice points of the output color gamut, LP1 denotes lattice points of the first color gamut, LP2 denotes lattice points of the second color gamut, and G denotes a gain value.

The gain value G is preferably set in a range of $0 \leq G \leq 1$.

For example, in a case where the gain value G is set to 1, the output color gamut To may be determined to be identical to the first color gamut T1. In a case where the gain value G is set to 0, the output color gamut To may be determined to be identical to the second color gamut T2.

As an example, a red point Ro in the lattice points LPo of the output color gamut To may be computed by the red point R1 of the first color gamut T1 and the red point R2 of the second color gamut T2, corresponding to the red point Ro of the output color gamut To.

That is, the red point Ro of the output color gamut To may be computed through the following formula.

$$Ro=(R1-R2)*G+R2$$

Here, Ro denotes a red point of the output color gamut, R1 denotes a red point of the first color gamut, R2 denotes a red point of the second color gamut, and G denotes a gain value.

In a case where the gain value G is set to 1, the red point Ro of the output color gamut To may be determined to be identical to the red point R1 of the first color gamut T1. In a case where the gain value G is set to 0, the red point Ro of the output color gamut To may be determined to be identical to the red point R2 of the second color gamut T2.

As another example, a blue point Bo in the lattice points LPo of the output color gamut To may be computed by the blue point B1 of the first color gamut T1 and the blue point B2 of the second color gamut T2, corresponding to the blue point Bo of the output color gamut To.

A green point Go, a cyan point Co, a magenta point Mo, a yellow point Yo, a white point Wo and a black point Bo, which constitute the other lattice points LPo of the output color gamut To, may also be determined by the lattice points LP1 of the first color gamut T1 and the lattice points LP2 of the second color gamut T2, which indicate colors corresponding to the other lattice points LPo of the output color gamut To, respectively.

The information of the first color gamut T1, the information of the second color gamut T2 and the information of the output color gamut To may be stored in a data store 50.

Figure 4A:
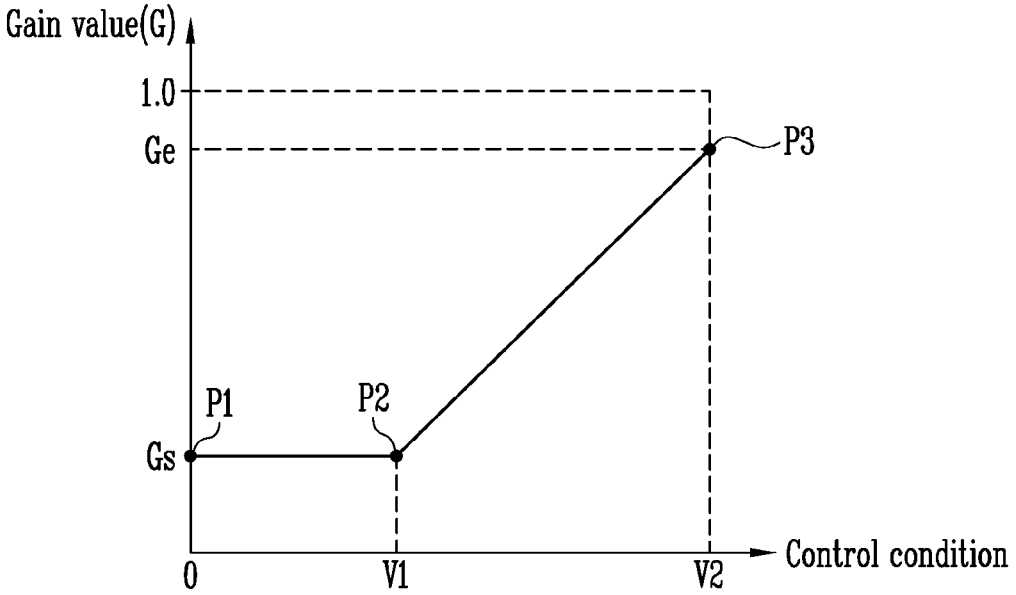
FIGS. 4A and 4B are graphs showing functions of control conditions and gain values according to an embodiment of the present invention.
Figure 4B:
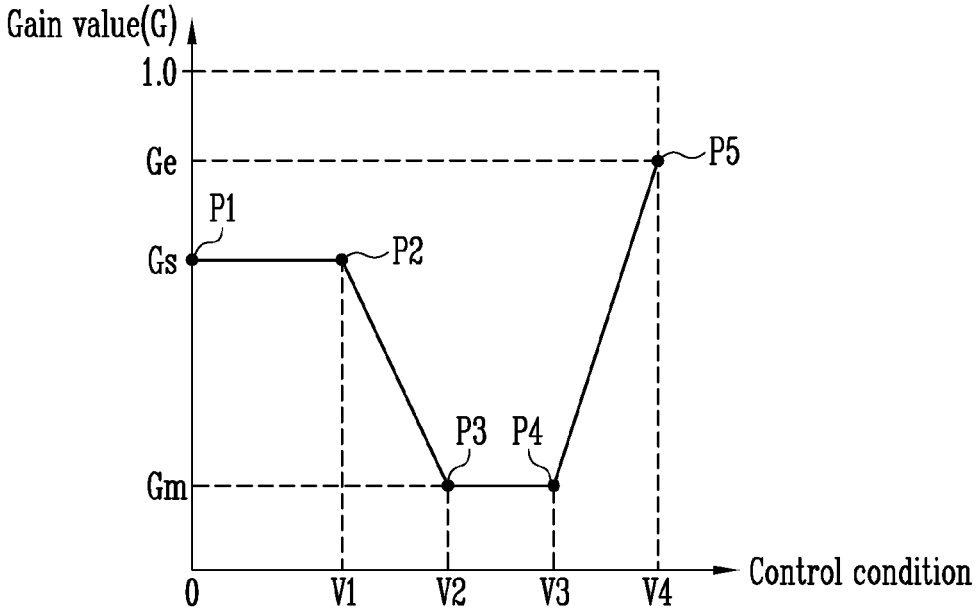
Figure 5:
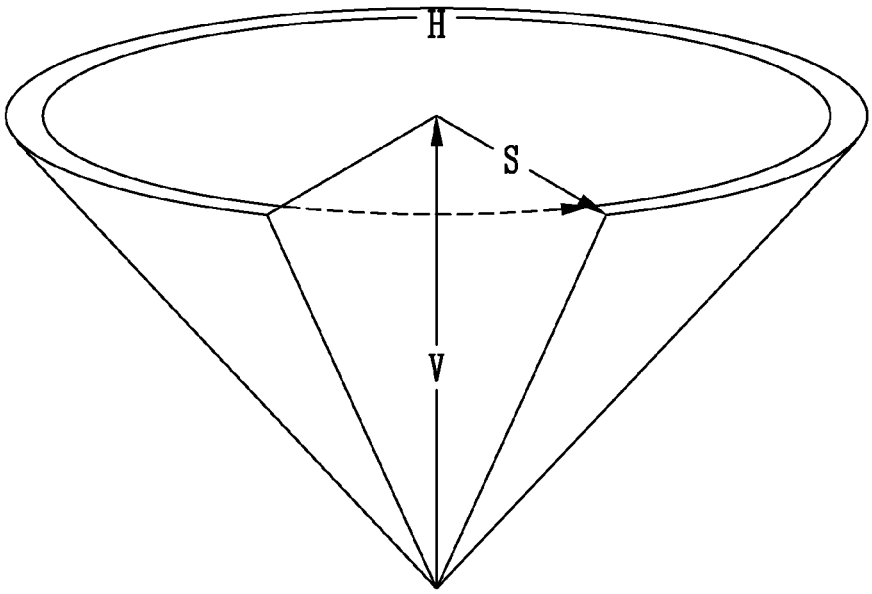
FIG. 5 is a diagram showing a hue, saturation and value (HSV) color space.

FIGS. 4A and 4B are graphs showing functions of control conditions and gain values according to an embodiment of the present invention. FIG. 5 is a diagram showing a hue, saturation and value (HSV) color space.

The gain value G may be set to have a correspondence relationship with a predetermined control condition. The gain value G may be stored in the data store 50.

Specifically, the correspondence relationship between the gain value G and the control condition may be defined by a predetermined function as shown in FIGS. 4A and 4B. The control condition and the gain value G may be transferred from an external microcomputer (MICOM) 60 so as to be stored in the data store 50.

The control condition may be set to at least one of chroma, intensity, multiplication of the chroma and the intensity, and external illumination degree.

The device 1 according to an embodiment may further include an image analyzer 10 for computing any one of the chroma and intensity of an input image data "Dimage".

The image analyzer 10 may detect a chroma "ch" or intensity "int" from the input image data "Dimage" and transfer the detected chroma "ch" or intensity "int" to the color gamut determinator 30. Alternatively, the image analyzer 10 may detect all the chroma "ch" or intensity "int" and transfer the detected chroma "ch" or intensity "int" to the color gamut determinator 30.

The image analyzer 10 may compute a chroma "ch" or intensity "int" from the input image data "Dimage" and then transfer, to the color gamut determinator 30, a value (ch*int) corresponding to the multiplication of the computed chroma "ch" or intensity "int".

The computation of the chroma and the intensity may be performed using the HSV color space as shown in FIG. 5.

For example, the input image data "Dimage" may be converted into a hue (H) signal, a saturation (S) signal and a value (V) signal in the HSV color space, and the chroma and the intensity may thereby be computed.

The method of computing the chroma and the intensity is known in the art, and therefore, its detailed description will be omitted.

The device 1 according to an embodiment may further include an illumination degree sensor 20 for sensing an external illumination degree.

The illumination degree sensor 20 may sense an external illumination degree "br" and transfer the sensed external illumination degree "br" to the color gamut determinator 30.

In a case where the control condition is set to the chroma, the function of a gain value G corresponding to the chroma "ch" is stored in the data store 50. The color gamut determinator 30 may determine a gain value G corresponding to the chroma "ch" of the input image data "Dimage" detected by the image analyzer 10 and then determine the output color gamut To using the method described above.

In a case where the control condition is set to the intensity, the function of a gain value G corresponding to the intensity is stored in the data store 50. The color gamut determinator 30 may determine a gain value G corresponding to the intensity "int" of the input image data "Dimage" detected by the image analyzer 10 and then determine the output color gamut To using the method described above.

In a case where the control condition is set to the multiplication of the chroma and the intensity, the function of a gain value G corresponding to the multiplication (ch*int) of the chroma "ch" and the intensity "int" is stored in the data store 50. The color gamut determinator 30 may determine a gain value G corresponding to the multiplication (ch*int) of the chroma "ch" and the intensity "int", detected by the image analyzer 10 and then determine the output color gamut To using the method described above.

In a case where the control condition is set to the external illumination degree, the function of a gain value G corresponding to the external illumination degree is stored in the data store 50. The color gamut determinator 30 may determine a gain value G corresponding to the external illumination degree "br" sensed by the illumination degree sensor 20 and then determine the output color gamut To using the method described above.

The function for defining the correspondence relationship between the control condition and the gain value G may be set by a parameter "par" transferred from the external MICOM 60.

Referring to FIG. 4A, the MICOM 60 may transfer, to the color gamut determinator 30, the parameter "par" including a start point P1, a first inflection point P2 and an end point P3, which define the function.

For example, the coordinates of the start point P1, the first inflection point P2 and the end point P3 may be set to (Gs, 0), (Gs, V1) and (Ge, V2), respectively.

The MICOM 60 may transfer a corresponding control condition together with the parameter "par", and the color gamut determinator 30 that has received the parameter "par" and the like may store them in the data store 50.

The MICOM 60 may immediately store the parameter "par" and the like in the data store 50 without passing through the color gamut determinator 30.

Referring to FIG. 4B, the MICOM 60 may transfer, to the color gamut determinator 30, the parameter "par" including a start point P1, a first inflection point P2, a second inflection point P3, a third inflection point P4 and an end point P5, which define the function.

For example, the coordinates of the start point P1, the first inflection point P2, the second inflection point P3, the third inflection point P4 and the end point P5 may be set to (Gs, 0), (Gs, V1), (Gm, V2), (Gm, V3) and (Ge, V4), respectively.

The parameter "par" may be configured with only the start and end points without any inflection point. In addition, the parameter "par" may be configured in various forms.

The color gamut mapper 40 may convert the color gamut of the input image data "Dimage" into the output color gamut To determined by the color gamut determinator 30.

Accordingly, an image data "Dimage'" of which the color gamut is newly mapped can be output by the color gamut mapper 40.

The output color gamut To may be stored in the data store 50.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method of mapping a color gamut, comprising:

receiving an input image data;

detecting a control condition including at least one of chroma of the input image data, intensity of the input image data, multiplication of the chroma and the intensity, and external illumination degree;

determining an output color gamut using information including lattice points of a first color gamut, information including lattice points of a second color gamut and a gain value corresponding to the control condition; and converting the color gamut of the input image data into the output color gamut, wherein lattice points of the output color gamut are computed by the following formula:

$$LPo=(LP1-LP2)*G+LP2,$$

wherein LPo denotes lattice points of the output color gamut, LP1 denotes lattice points of the first color gamut, LP2 denotes lattice points of the second color gamut, and G denotes a gain value.

2. The method according to claim 1, wherein the gain value is set to a value between 0 and 1.

3. The method according to claim 1, wherein the correspondence relationship between the control condition and the gain value is defined by a function.

4. The method according to claim 3, wherein the function of the control condition and the gain value is defined by a parameter transferred from an external MICOM.

5. The method according to claim 4, wherein the parameter includes a start point, a first inflection point and an end point.

6. The method according to claim 4, wherein the parameter includes a start point, a first inflection point, a second inflection point, a third inflection point and an end point.

* * * * *